US006032501A

United States Patent [19]

Bihrer

[11] Patent Number: 6,032,501

[45] Date of Patent: Mar. 7, 2000

[54] METHOD OF HYDROFORMING MULTI-LATERAL MEMBERS FROM ROUND TUBES

[75] Inventor: Otto Bihrer, Rochester, Mich.

[73] Assignee: The Budd Company, Troy, Mich.

[21] Appl. No.: 09/247,457

[22] Filed: Feb. 9, 1999

[51] Int. Cl.[7] ..... B21D 26/02; B21D 39/08

[52] U.S. Cl. ..... 72/58; 72/62

[58] Field of Search ..... 72/57, 58, 61, 72/62; 29/421.1

[56] References Cited

U.S. PATENT DOCUMENTS

| | | | |
|---|---|---|---|
| 2,205,893 | 6/1940 | Unger . | |
| 3,564,886 | 2/1971 | Nakamura . | |
| 3,685,327 | 8/1972 | Nakamura . | |
| 4,567,743 | 2/1986 | Cudini . | |
| 4,751,835 | 6/1988 | Galaniuk et al. . | |
| 4,951,492 | 8/1990 | Vogt . | |
| 5,107,693 | 4/1992 | Olszewski et al. . | |
| 5,157,969 | 10/1992 | Roper . | |
| 5,233,854 | 8/1993 | Bowman et al. . | |
| 5,239,852 | 8/1993 | Roper . | |
| 5,303,570 | 4/1994 | Kaiser . | |
| 5,333,775 | 8/1994 | Bruggemann et al. . | |
| 5,339,667 | 8/1994 | Shah et al. | 72/58 |
| 5,471,857 | 12/1995 | Dickerson . | |
| 5,557,961 | 9/1996 | Ni et al. | 72/61 |
| 5,813,266 | 9/1998 | Ash | 72/58 |
| 5,815,901 | 10/1998 | Mason et al. | 72/58 |
| 5,862,877 | 1/1999 | Horton et al. | 72/61 |
| 5,953,945 | 9/1999 | Horton | 72/58 |

FOREIGN PATENT DOCUMENTS

| | | |
|---|---|---|
| 0 588 528 A1 | 3/1994 | European Pat. Off. . |
| 0 686 440 A1 | 12/1995 | European Pat. Off. . |
| 385146 | 3/1965 | Switzerland . |

OTHER PUBLICATIONS

Dohmann/Klass, "Methods of Tube Forming", *Strips Sheets Tubes*, (Mar. 1986), pp. 39–41.

Sawyer, Christopher A., "Hydro–Forming is Hot", *Automotive Industries*, (Jun., 1991), pp. 49, 51.

Mason, Murray, "Hydroform Tubes for Automotive Body Structure Applications", *SAE Technical Paper Series*, Series No. 930575, (May, 1993), pp. 59–64.

Pennington, J. Neiland, "Hydroforming: More part for less cost in GM luxury/performance cars", *Modern Metals*, (Oct., 1994), pp. 36, 38, 40–41.

"Hyprotec Delivery to North America Completed", *Hyprotec—News*, (1995), pp. 1–4.

"The Modular IHP Plant System", *H&B Hyprotec Technologie oHG*, (Jan., 1995).

Christensen, William L., "Hydroforming of Tubular Sections", *MetalForming*, (Oct., 1995), pp. 36–38, 40,43.

*Primary Examiner*—David Jones

*Attorney, Agent, or Firm*—Harness, Dickey & Pierce, P.L.C.

[57] ABSTRACT

A method is provided for forming an elongated multi-lateral member from a round tube. A die is provided having a first die member and a second die member movable relative to the first die member between open and closed positions. The first and second die members define a first pair of opposed surfaces which each lie in a plane angled slightly with respect to an axis of movement of the second die member. The first and second die members further define a second pair of opposed surfaces which lie in a plane generally perpendicular to the first pair of opposed surfaces and which combine with the first pair of opposed surfaces to define a die cavity. The first pair of opposed surfaces are angled slightly relative to an axis of movement of the second die member in order to allow separation of the first and second die members while providing a small projected surface in the direction perpendicular to the axis of movement of the second die member such that the amount of force necessary to hold the second die member in a closed position during the step of expanding the tube by hydroforming is kept to a minimum.

14 Claims, 5 Drawing Sheets

METHOD OF HYDROFORMING MULTI-LATERAL MEMBERS FROM ROUND TUBES

BACKGROUND OF THE INVENTION

Field of the Invention

The present invention relates to a method of forming an elongated multi-sided member from a round tube using preforming and hydroforming techniques. More specifically, this invention relates to a die and a method for hydroforming an elongated multi-sided member with reduced die closing forces.

BACKGROUND AND SUMMARY OF THE INVENTION

Elongated multi-sided members, e.g., those with cross-sections such as squares or rectangles, are used in certain industries, such as the automotive industry, where strength, weight, and the ability to attach subassemblies are design criteria. The process for extruding multi-sided frame members is cost prohibitive. Consequently, materials are purchased in the form of round tubes and then the round tubes are shaped into multi-sided members. One possible method of shaping a round tube into a multi-sided member is the use of preforming and hydroforming techniques.

Preforming is a method of bending an elongated tube through the use of external die members to roughly relate a tube to a cavity in a die. Hydroforming, on the other hand, is a method of expanding an elongated tube to closely correspond to a cavity in a die through the use of internal hydraulic pressure. When used consecutively, a round tube may be formed into an elongated multi-lateral member through the use of both preforming and hydroforming techniques.

The process for hydroforming large tubular members requires generally large die closing forces. In general, the die closing forces required during a hydroforming process is related to the internal hydraulic pressure and the projected surface area of the die cavity which is provided in the lateral direction of the die cavity relative to the direction of movement of the movable die member. With large tubular members, such as vehicle frame side rails, the force required for holding the die closed is typically very large. Therefore, large amounts of counter-weight or counter-hydraulic pressure is required to keep the die closed during a hydroforming process. The additional weight or hydraulic pressure that is required to hold the die closed, greatly increases the cost of the die assembly as well as the manufacture of the hydroformed parts. In particular, if increased counterweights are used for counteracting the hydroforming forces, additional hydraulic pressure is required for moving the additional counterweight with each die cycle. Furthermore, if additional counter-hydraulic pressure is used, additional energy is required to generate the additional amount of hydraulic pressure needed.

Accordingly, it is desirable to provide a die and a method for hydroforming a large member such as a side rail of a vehicle frame with minimized closing forces required for holding the die in the closed position.

The present invention provides a method of forming an elongated multi-lateral member from a round tube, including the step of preforming a round tube between a first pair of opposed surfaces to approximately correspond to the pair of opposed surfaces and thereby forming the round tube into a partially flattened tube having a generally dogbone cross-section.

A hydroforming die is provided having a first die member and a second die member movable relative to the first die member between open and closed positions. The first and second die members define a first pair of opposed surfaces which each lie in a plane angled slightly with respect to an axis of movement of the second die member. The first and second die members further define a second pair of opposed surfaces which lie in a plane generally perpendicular to the first pair of opposed surfaces and which combine with the first pair of opposed surfaces to define a die cavity. The second die member is moved to an open position and the preformed partially flattened tube is placed into the die cavity. The preformed tube is preformed again between the second pair of opposed surfaces to approximately correspond to the second pair of opposed surfaces by moving the second die member to a closed position. A hydraulic pressure source is connected to an interior of the tube and thereby expands the tube so as to conform to a shape of the die cavity. The first pair of opposed surfaces have a greater dimension than the second pair of opposed surfaces and the first pair of opposed surfaces are angled slightly relative to an axis of movement of the second die member in order to allow separation of the first and second die members while providing a small projected surface in the direction perpendicular to the axis of movement of the second die member such that the amount of force necessary to hold the second die member in a closed position during the step of expanding the tube is kept to a minimum.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 2A:
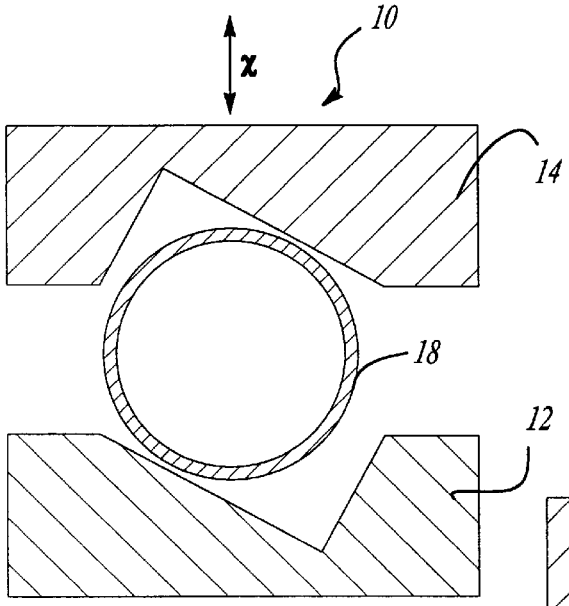
Fig-2a Prior Art
FIGS. 2*a* and 2*b* are sectional views of a conventional hydroforming die shown in the open and closed positions.
Figure 2B:
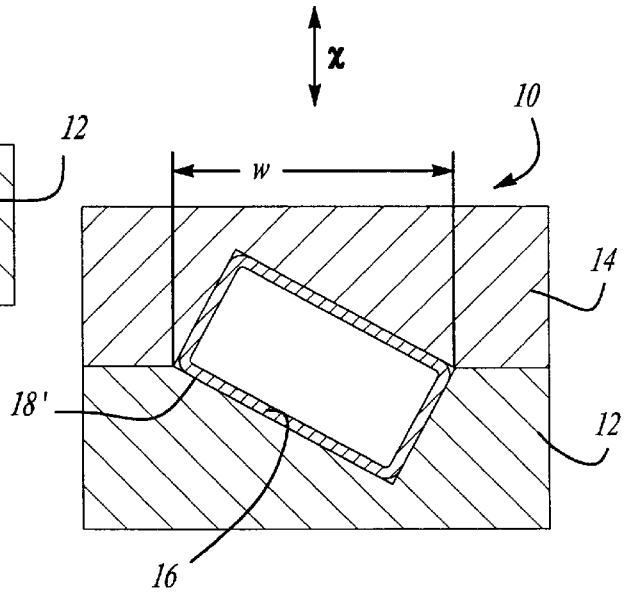
Fig-2b Prior Art

With reference to FIGS. 2*a* and 2*b,* a description of the prior art hydroforming technique for forming multi-lateral members will be described. The hydroforming technique according to the prior art includes providing a die 10 including a lower portion 12 and an upper portion 14 which combine to define a die cavity 16. As the upper portion 14 is moved to a closed position, the round tube 18 is partially flattened into a generally oval shape. The die cavity 16 which is formed by the upper and lower portions 12, 14 is oriented generally diagonally. The diagonal orientation of the hydroforming die cavity 16 allows the upper die portion 14 to be removed from the hydroformed part 18 without any interference from the sidewalls of the part 18'.

Generally, this type of design which is commonly used throughout the industry, is sufficient for smaller hydroformed parts. However, as the size of the hydroformed parts become larger, such as for a side rail of a vehicle frame, the amount of internal hydraulic pressure which is required to deform the member 18 greatly increases. In addition, as the pressure increases and the size of the die cavity increases, the amount of force necessary for holding the upper die portion 14 in the closed position is also increased. The force necessary for holding the upper die portion 14 in a closed position is generally related to the projected surface area (A) times the internal pressure (P). (F=P*A) The projected surface area A is equal to the length (L) of the die cavity times the width (W) of the die cavity in the direction perpendicular to the axis of movement (x) of the second die member 14.

Figure 1A:
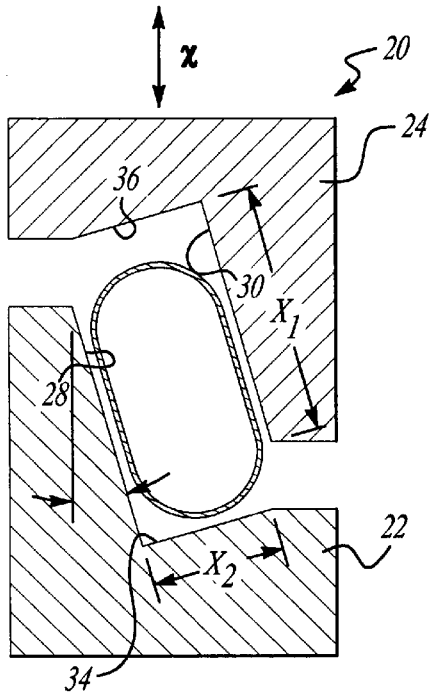
FIGS. 1*a* and 1*b* are sectional views of a hydroforming die according to the principles of the present invention, showing two different stages of a forming process.
Figure 1B:
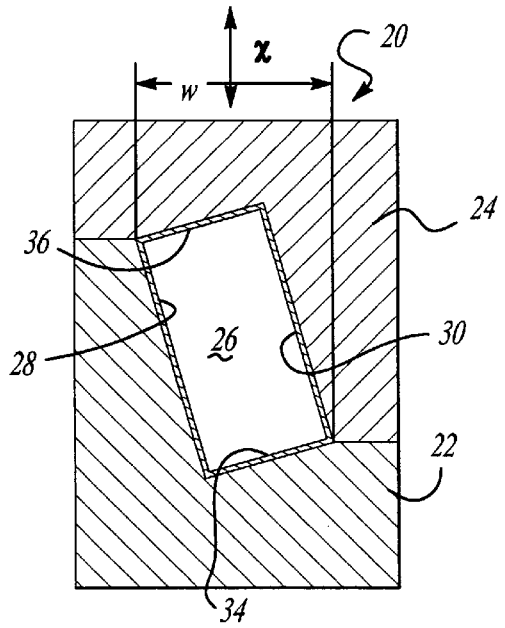

Accordingly, the present invention attempts to minimize the amount of force necessary to hold the upper die portion in a closed position during a hydroforming process by orienting the die cavity to provide the smallest projected surface possible in the direction transverse to the axis of motion of the upper die member. With reference to FIGS. 1*a* and 1*b,* a die 20 according to the principles of the present invention is shown. The die 20 includes a fixed first die member 22 and a movable second die member 24. The first and second die members 22, 24 define a die cavity 26 which is provided with a first pair of opposed surfaces 28, 30 which each lie in a plane angled slightly with respect to an axis of movement x of the second die member 24. The first and second die members 22, 24 further define a second pair of opposed surfaces 34, 36, which combine with the first pair of opposed surfaces 28, 30 to define the die cavity 26. The first pair of opposed surfaces 28, 30 have a greater dimension $L_1$ than the pair of opposed surfaces 34, 36 ($L_2$).

The first pair of opposed surfaces 28, 30 each lie in a plane which is offset by an angle $\alpha$ relative to an axis of movement x of the second die member 24. The angle $\alpha$ is preferably between three (3) and seven (7) degrees from the axis of movement of the second die member 24. The slight angular orientation $\alpha$ of the first pair of opposed surfaces 28, 30 allows for separation of the first and second die members 22, 24 after a hydroforming process has been performed. The object of the present invention is to provide approximately the smallest angle $\alpha$ which allows for separation of the first and second die members 22, 24 while providing the smallest projected surface A in the direction perpendicular to the axis of movement x of the second die member 24 such that the amount of force necessary to hold the second die member in a closed position during the step of expanding the tube is kept to a minimum. As discussed above, the force necessary for holding the die closed is related to the internal pressure P that is introduced to expand the tubular member and the projected surface area A. As shown in FIGS. 1*a* and 1*b,* the first die member 22 provides surfaces 28, 34 which define the shape of two of the walls of the multi-lateral tubular member, while the second die portion 24 includes surfaces 30, 36 which define the shape of the remaining two walls of the multi-lateral tubular member.

In operation, the method of forming an elongated multi-lateral member from a round tube, according to the present invention, includes the step of preflattening a round tube between a first pair of opposed surfaces to approximately correspond to the pair of opposed surfaces and thereby forming the round tube into a partially flattened tube 38. While preforming to adapt a part to a final part form is common, the preforming/flattening step, according to the present invention, is utilized for the novel purpose of flattening the part in order to reduce the projected surface of the tube for fitting into the hydroforming die and to prepare the part unfolding which will be described in greater detail herein.

Figure 6A:
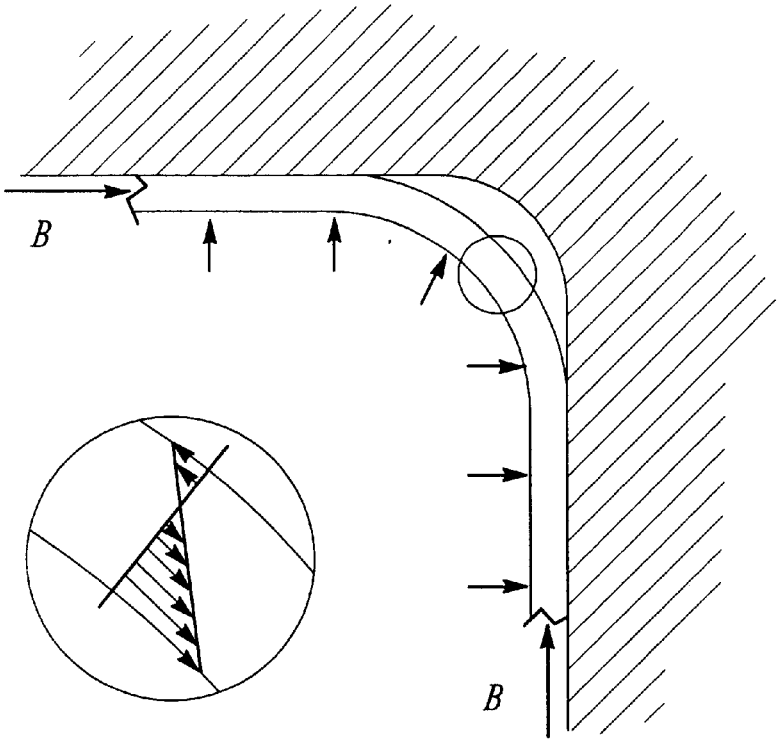
FIG. 6*a* illustrates the forces applied to a preformed tube having a dogbone cross-section during a hydroforming operation.
Figure 6B:
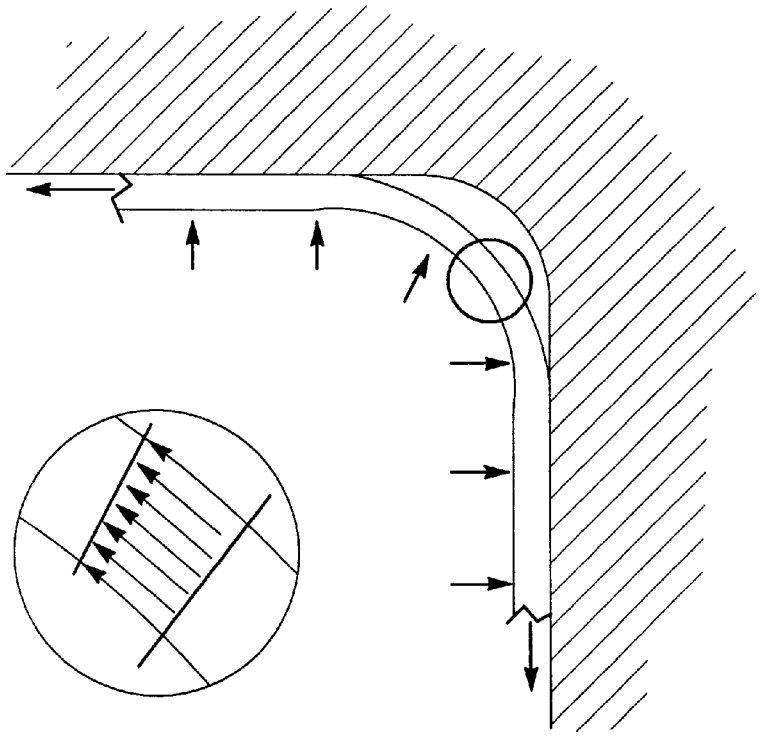
FIG. 6*b* illustrates the forces applied to a preformed tube having a generally oval cross-section during a hydroforming operation

The hydroforming of a round tube into a rectangular (or other geometric shape) cross-section requires a "tube crashing" forming operation so that the round tube can fit in the die. The tube crashing process provides a "dogbone" cross-section which is highly advantageous to the filling of the die corners (FIG. 6*a*). By "dogbone" cross-section, it is meant that the tube has two bulbous shaped end portions connected to one another by a relatively narrow neck portion. Without the dogbone shape, pressurization of the tube during hydroforming stretches material into the die corners (FIG. 6*b*).

There are two disadvantages to stretching material into the die corners. First, the internal pressure generates considerable friction between the outside of the tube and the die wall. Due to the friction, the tube wall "locks" against the die and stretching into the corner is localized as illustrated in FIG. 6*b,* often leading to bursting of the tube. Second, the pressure required to produce a tight radius is quite large. The radius to be formed is related to the required internal pressure by the hoop stress formula, $P=\sigma t/R$, where P is the pressure, $\sigma$ is approximately the material tensile strength, t is the wall thickness, and R is the radius to be formed. The large pressure required to form a small radius requires large holding forces to keep the die closed during hydroforming.

With the dogbone cross-section, as the inwardly curved sidewalls (the neck portion) flatten out, material is pushed into the die corners, as illustrated by Arrows "B" in FIG. 6*a,* and the filling of the die radii results mainly from a bending mode of forming. The bending of the tube wall into the die radii requires much less force than the stretching mode. Hence, lower pressures are needed for forming the tube and therefore, a smaller press may be used.

Figure 4A:
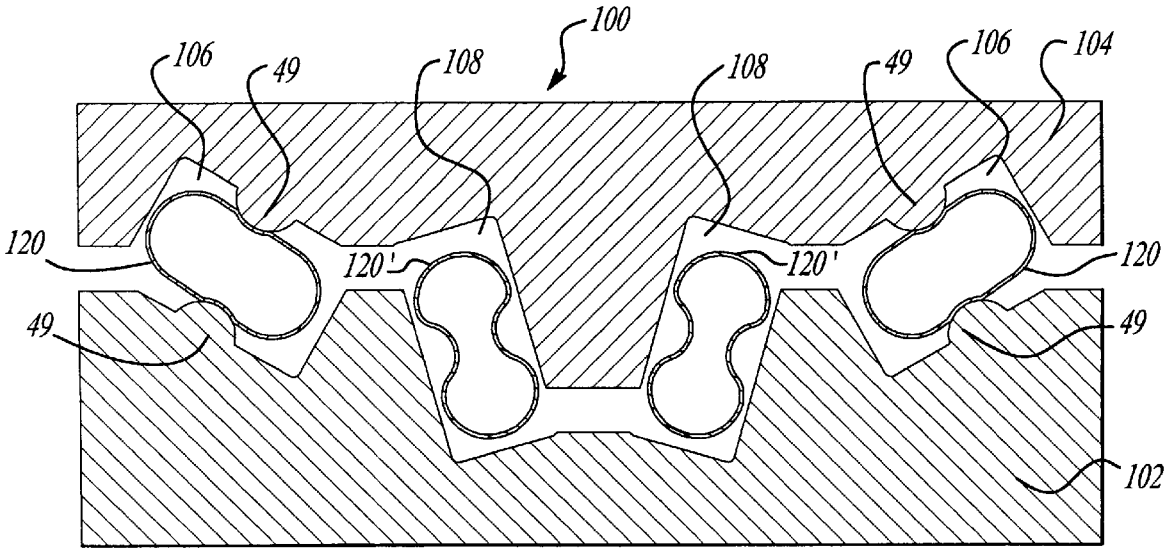
FIGS. 4*a* and 4*b* are sectional views of a hydroforming die according to the principles of the present invention with a pair of preforming die cavities and a pair of hydroforming die cavities provided in one die.
Figure 4B:
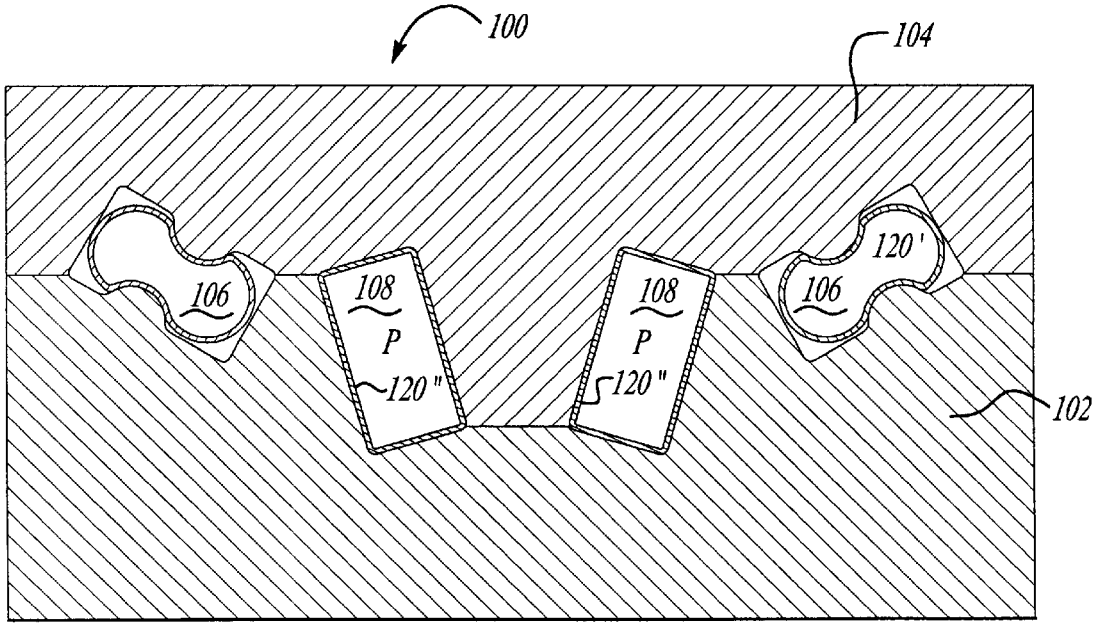

The development of the dogbone cross-section occurs readily in straight sections of the tube during the tube crashing/forming operation. However, in curved sections, a fold in the tube wall often develops. Furthermore, the dogbone cross-section is not well developed in the curved section. To encourage the development of the dogbone shape, a half-cylinder shape protrusion 39 as shown in FIGS. 4*a* and 4*b* (for example) can be attached to the inside of the die cavity. This modification can be applied to either the top or bottom of the die (or both). This half cylinder 39 will push the tube wall inward before the rest of the die cavity makes contact with the tube, resulting in the dogbone cross-section. This method can also be applied to straight sections. By controlling the size and shape of the die cavity addition, the shape of the dogbone cross-section can be optimized. Although a half-cylinder shape 39 was described here, the shape of this die modification can include square, trapezoidal, or other geometrical shapes.

The preformed or flattened tube 38 is inserted into the hydroforming die 20. The tube 38 is preformed again between the second pair of opposed surfaces 34, 36 to approximately correspond to the second pair of opposed surfaces by moving the second die member 24 to a closed position. A hydraulic pressure source is connected to an interior of the tube 38 and thereby expands the tube 38' so as to conform to a shape of the die cavity 26.

Figure 3A:
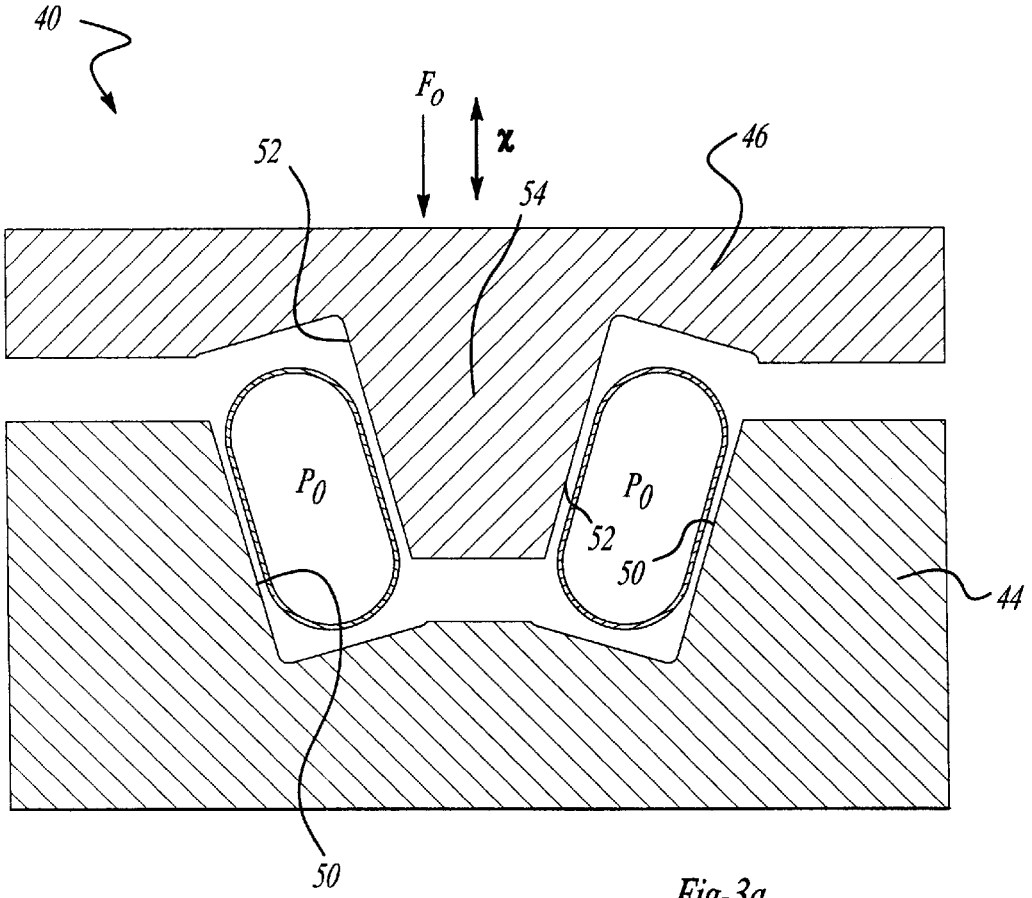
FIGS. 3*a* and 3*b* are sectional views of a hydroforming die according to the principles of the present invention with two die cavities symmetrically provided in one die.
Figure 3B:
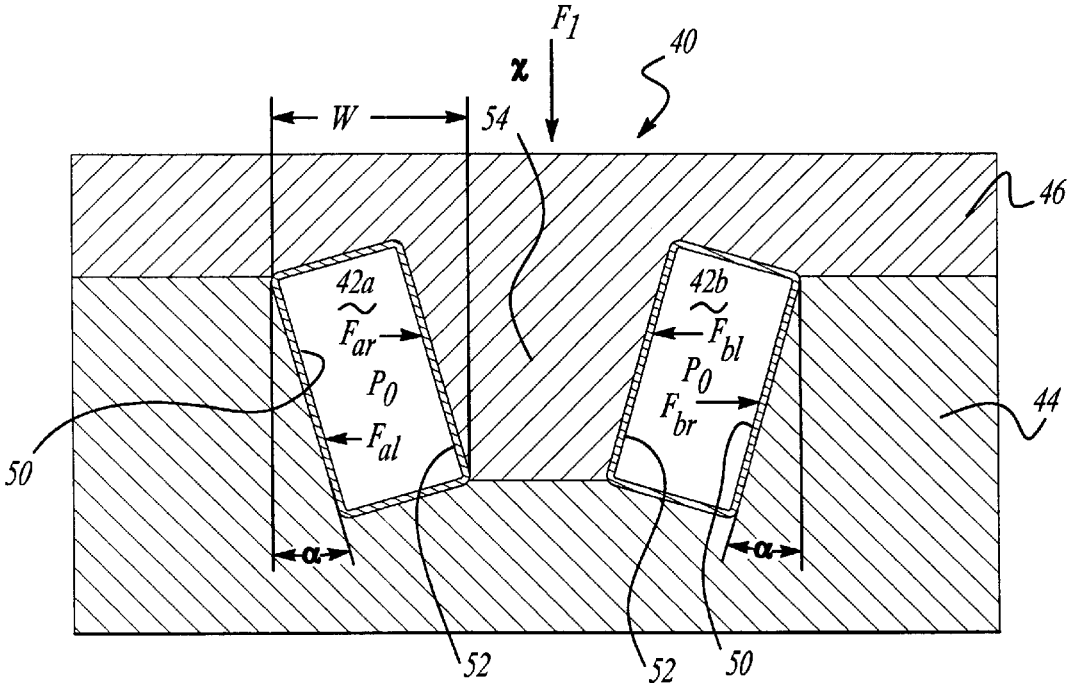

With reference to FIGS. 3*a* and 3*b*, another embodiment of the present invention is shown wherein a die 40 is provided with two die cavities 42*a*, 42*b*. Die cavities 42*a*, 42*b* are defined between a fixed first die portion 44 and a movable second die portion 46. Each of the die cavities 42*a*, 42*b* are angularly offset symmetrically by an angle $\alpha$, as discussed above, relative to the axis of movement x of the second die member 46. According to this invention, the force necessary for holding the upper die member 46 in a closed position is minimized due to the die cavities 42*a*, 42*b* being only slightly angularly offset (by an angle $\alpha$) relative to the axis of movement of the upper die member 46 so that the smallest projected surface A is provided while permitting removal of upper die member 46. Furthermore, due to the symmetric orientation of the die cavities 42*a*, 42*b* the lateral forces $F_{AL}$, $F_{AR}$, $F_{BL}$, $F_{BR}$ from each of the die cavities 42*a*, 42*b* balance one another.

In particular, during a hydroforming process, the hydroforming that takes place in die cavity 42*a* will produce laterally outward forces $F_{AL}$ in a leftward direction as shown in FIG. 3*b*, while approximately equal and opposite forces $F_{BR}$ will be provided in a laterally rightward direction by the hydroforming process in die cavity 42*b*. Likewise, laterally rightward forces $F_{AR}$ will be applied to the second die member 46 during the hydroforming process in die cavity 42*a*, while approximately equal and opposite forces $F_{BL}$ will be applied in a laterally leftward direction from die cavity 42*b*. Thus, the lateral forces $F_{AL}$, $F_{AR}$, $F_{BL}$, $F_{BR}$ generated during the hydroforming process will generally balance one another in the lateral directions while the forces $F_1$ required for maintaining the upper die member 46 in a closed position are minimized due to the die cavities 42*a*, 42*b* being oriented so as to provide the smallest projected surface while still allowing the upper die member 46 to be removed from the lower die member 44. In other words, each of the die cavities 42*a*, 42*b* have opposed sidewall surfaces 50, 52 which are angularly offset from an axis of movement of the second die member 46 at an angle $\alpha$. Furthermore, each of the die cavities 42*a*, 42*b* are angularly offset symmetrically in opposite directions such that the sidewall surfaces 52 of each die cavity 42*a*, 42*b* are each provided on a downwardly protruding central portion 54 of the upper die member 46.

Figure 5:
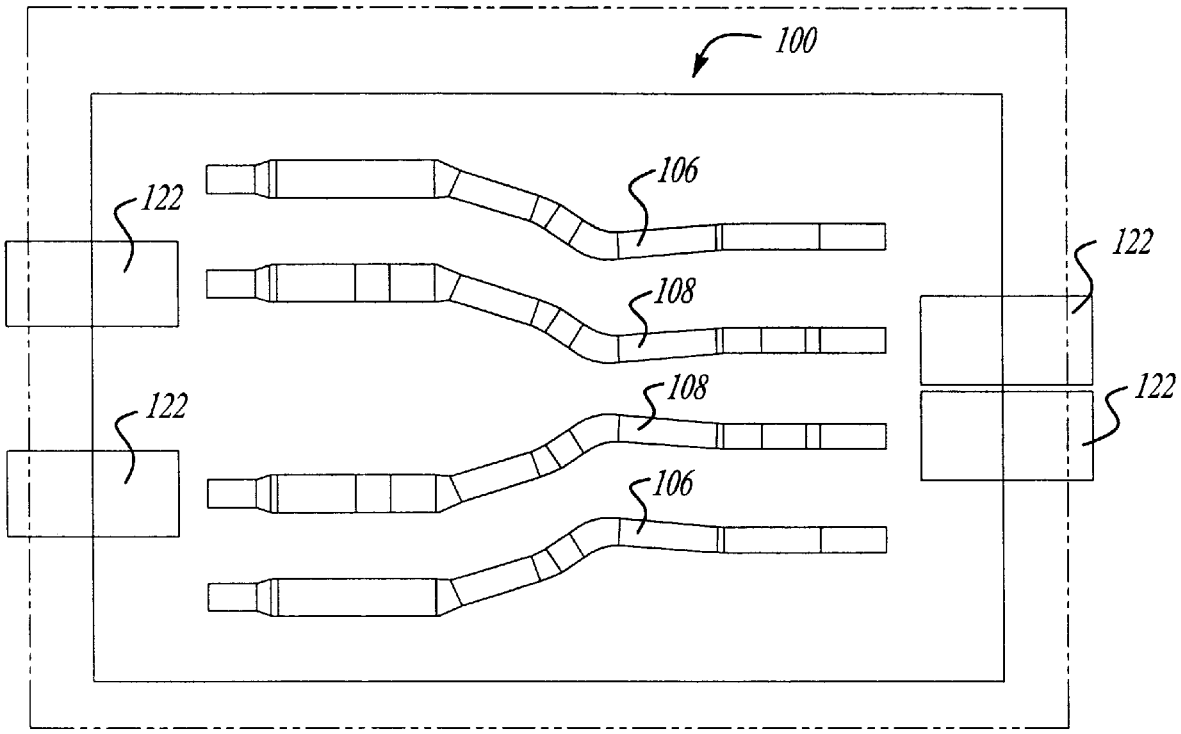
FIG. 5 shows a top plan view of the die which illustrates a pair of preforming die cavities and a pair of hydroforming die cavities according to the principles of the present invention.

With reference to FIGS. 4 and 5, a further embodiment of the present invention will be described. As shown in FIGS. 4*a* and 4*b*, a die 100 is provided with a fixed die member 102 and a movable die member 104. The die 100 defines a pair of preforming die cavities 106 and a pair of hydroforming die cavities 108. The die cavity pairs 106 and 108 are mirror images to one another. The tubes are preformed in the die cavities 106 in order to flatten the tube, preferably into a dogbone cross-section, as discussed above. From the die cavities 106, the pre-flattened tubes are moved to the hydroforming die cavities 108 where the tubes are hydroformed according to the principles as discussed above. Because the die cavities 106, 108 are mirror images of one another, the lateral forces from each of the die cavities generally balance one another. Furthermore, because the tubes are preformed into a flattened condition and further formed into a dogbone cross-section, the internal pressure required for hydroforming the tubular members minimized. In addition, because the hydroforming die cavities are angularly offset at an angle $\alpha$, as discussed above, the closing forces required for holding the die in a closed position are minimized.

As shown in FIGS. 4*a* and 4*b*, the preforming die cavities 106 are provided with half cylinder projections 49 in both the upper and lower die members 102, 104. As the die 100 is brought to a closed condition, the half cylinder projections form the indented sidewalls of the dogbone cross-section tube member. According to this embodiment of the present invention, a first pair of tubular members 120 can be preformed in a single die cycle while at the same time a second pair of preformed tubular members 120' can be hydroformed into their final desired shape 120". The tubular members can be moved into and out of the die cavities manually, but are preferably positioned by a robotic device, as would be understood by one skilled in the art. It should be understood that the tubular members which are flattened in preforming cavities 106 are initially preformed using standard techniques in order to bend the tubular members to a shape corresponding with the bends in the preforming die cavities 106, as best shown in FIG. 5. As shown in FIG. 5, the hydroforming die cavities 108 are provided with connecting rod fill ends 122 as is well known in the hydroforming art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of hydroforming an elongated multilateral member, comprising the steps of:

providing a die having a first die member and a second die member movable relative to said first die member between open and closed positions, said first and second die members defining a first pair of opposed surfaces which each lie in a plane angled slightly with respect to an axis of movement of said second die member, said first and second die members further defining a second pair of opposed surfaces which lie in a plane generally perpendicular to said first pair of opposed surfaces and which combine with said first pair of opposed surfaces to define a die cavity;

moving said second die member to an opened position and placing a tube into said die cavity;

connecting a hydraulic pressure source to an interior of said tube and thereby expanding the tube so as to conform to a shape of said die cavity;

wherein said first pair of opposed surfaces have a greater dimension than said second pair of opposed surfaces and said first pair of opposed surfaces are angled slightly relative to an axis of movement of the second die member in order to allow separation of the first and second die members while providing a smallest projected surface in the direction perpendicular to the axis of movement of the second die member such that the amount of force necessary to hold the second die member in a closed position during said step of expanding the tube, is kept to a minimum.

2. The method according to claim 1, wherein said first pair of opposed surfaces are angled between 3 and 7 degrees relative to said axis of movement of said second die member.

3. A method of hydroforming an elongated multilateral member, comprising the steps of:

providing a die having a first die member and a second die member movable relative to said first die member between open and closed positions, said first and second die members defining a pair of symmetrically disposed die cavities each including a first pair of opposed surfaces which each lie in a plane angled slightly with respect to an axis of movement of said second die member, said pair of die cavities further including a second pair of opposed surfaces which lie in a plane generally perpendicular to said first pair of opposed surfaces and which combine with said first pair of opposed surfaces to define said pair of die cavities;

moving said second die member to an opened position and placing a pair of tubes into said pair of die cavities;

connecting a hydraulic pressure source to an interior of said pair of tubes and thereby expanding the tubes so as to conform to a shape of said die cavities;

wherein said first pair of opposed surfaces of each of said die cavities are angled slightly relative to an axis of movement of the second die member in order to allow separation of the first and second die members while providing a smallest projected surface in the direction perpendicular to the axis of movement of the second die member such that the amount of force necessary to hold the second die member in a closed position during said step of expanding the tubes, is kept to a minimum.

4. The method according to claim 3, wherein said first pair of opposed surfaces are angled between 3 and 7 degrees relative to said axis of movement of said second die member.

5. A method of forming an elongated multilateral member from a round tube, comprising the steps of:

preforming a round tube between a first pair of opposed surfaces to approximately correspond to the first pair of opposed surfaces and thereby forming the round tube into an oval tube having a generally oval cross section;

providing a die having a first die member and a second die member movable relative to said first die member between open and closed positions, said first and second die members defining a first pair of opposed surfaces which each lie in a plane angled slightly with respect to an axis of movement of said second die member, said first and second die members further defining a second pair of opposed surfaces which lie in a plane generally perpendicular to said first pair of opposed surfaces and which combine with said first pair of opposed surfaces to define a die cavity;

moving said second die member to an opened position and placing said preformed oval tube into said die cavity;

preforming the oval tube between the second pair of opposed surfaces to approximately correspond to the second pair of opposed surfaces by moving said second die member to a closed position; and connecting a hydraulic pressure source to an interior of said tube and thereby expanding the tube so as to conform to a shape of said die cavity;

wherein said first pair of opposed surfaces have a greater dimension than said second pair of opposed surfaces and said first pair of opposed surfaces are angled slightly relative to an axis of movement of the second die member in order to allow separation of the first and second die members while providing a smallest projected surface in the direction perpendicular to the axis of movement of the second die member such that the amount of force necessary to hold the second die member in a closed position during said step of expanding the tube, is kept to a minimum.

6. A method of hydroforming an elongated multilateral member from a round tube, comprising the steps of:

preforming said round tube by flattening said round tube into a dogbone cross-section;

providing a die having a first die member and a second die member movable relative to said first die member between open and closed positions, said first and second die members defining a first pair of opposed surfaces which each lie in a plane angled slightly with respect to an axis of movement of said second die member, said first and second die members further defining a second pair of opposed surfaces which combine with said first pair of opposed surfaces to define a die cavity;

moving said second die member to an opened position and placing said preformed tube, having a dogbone cross-section, into said die cavity;

connecting a hydraulic pressure source to an interior of said tube and thereby expanding the tube so as to conform to a shape of said die cavity;

wherein said first pair of opposed surfaces are spaced apart a distance smaller than a dimension of said first pair of opposed surfaces, and said first pair of opposed surfaces are angled slightly relative to an axis of movement of the second die member in order to allow separation of the first and second die members while providing a smallest projected surface in the direction perpendicular to the axis of movement of the second die member such that the amount of force necessary to hold the second die member in a closed position during said step of expanding the tube, is kept to a minimum, said step of flattening said round tube being performed to reduce a projected surface of said tube in order to fit within said die cavity.

7. The method according to claim 6, wherein said first pair of opposed surfaces are angled between 3 and 7 degrees relative to said axis of movement of said second die member.

8. A method of hydroforming an elongated multilateral member from round tubes, comprising the steps of:

preforming said round tubes by flattening said round tubes into a dogbone cross-section;

providing a die having a first die member and a second die member movable relative to said first die member between open and closed positions, said first and second die members defining a pair of symmetrically disposed die cavities each including a first pair of opposed surfaces which each lie in a plane angled slightly with respect to an axis of movement of said second die member, said pair of die cavities further including a second pair of opposed surfaces which lie in a plane generally perpendicular to said first pair of opposed surfaces and which combine with said first pair of opposed surfaces to define said pair of die cavities;

moving said second die member to an opened position and placing a pair of preformed tubes into said pair of die cavities; and connecting a hydraulic pressure source to an interior of said pair of preformed tubes and thereby expanding the tubes so as to conform to a shape of said die cavities.

9. The method according to claim 8, wherein said first pair of opposed surfaces of each of said die cavities are angled slightly relative to an axis of movement of the second die member in order to allow separation of the first and second die members while providing a smallest projected surface in the direction perpendicular to the axis of movement of the second die member such that the amount of force necessary to hold the second die member in a closed position during said step of expanding the tubes, is kept to a minimum.

10. The method according to claim 9, wherein said first pair of opposed surfaces are angled between 3 and 7 degrees relative to said axis of movement of said second die member.

11. A method of forming an elongated multilateral member from a round tube, comprising the steps of:

providing a die having a first die member and a second die member movable relative to said first die member between open and closed positions, said first and second die members defining a preforming die cavity and a hydroforming die cavity including a first pair of opposed surfaces which each lie in a plane angled slightly with respect to an axis of movement of said second die member, said first and second die members further defining a second pair of opposed surfaces which lie in a plane generally perpendicular to said first pair of opposed surfaces and which combine with said first pair of opposed surfaces to define said hydroforming die cavity;

moving said second die member to an opened position and placing a round tube into said preforming die cavity and a preformed tube into said hydroforming die cavity; and preforming said round tube in said preforming die cavity thereby partially flattening said round tube;

connecting a hydraulic pressure source to an interior of said preformed tube in said hydroforming die cavity and thereby expanding the tube so as to conform to a shape of said hydroforming die cavity;

wherein said first pair of opposed surfaces of said hydroforming die cavity have a greater dimension than said second pair of opposed surfaces and said first pair of opposed surfaces are angled slightly relative to an axis of movement of the second die member in order to allow separation of the first and second die members while providing a smallest projected surface in the direction perpendicular to the axis of movement of the second die member such that the amount of force necessary to hold the second die member in a closed position during said step of expanding the tube, is kept to a minimum.

12. The method according to claim 11, wherein said first pair of opposed surfaces are angled between 3 and 7 degrees relative to said axis of movement of said second die member.

13. The method according to claim 11, wherein said step of preforming said tube includes forming said tube into a generally dogbone shaped cross section having two bulbous shaped end portions connected to one another by a relatively narrow neck portion.

14. A die device for hydroforming an elongated multilateral member, comprising:

a first die member and a second die member movably disposed relative to said first die member, said first and second die members defining a hydroforming die cavity having a first pair of opposed surfaces which each lie in a plane angled between 3 and 7 degrees with respect to an axis of movement of said second die member, said hydroforming die cavity further including a second pair of opposed surfaces which combine with said first pair of opposed surfaces to define said hydroforming die cavity, wherein said first pair of opposed surfaces have a dimension greater than said second pair of opposed surfaces and the angular orientation of said first pair of opposed surfaces relative to said axis of movement of said second die member allows separation of the first and second die members while providing a smallest projected surface in the direction perpendicular to the axis of movement of the second die member such that the amount of force necessary to hold the second die member such that the amount of force necessary to hold the second die member in a closed position during hydroforming a tube in the hydroforming die cavity is kept to a minimum.

* * * * *